US011371453B2

(12) United States Patent
Fey

(10) Patent No.: US 11,371,453 B2
(45) Date of Patent: Jun. 28, 2022

(54) METHOD FOR REGULATING A FILL OF AN EXHAUST COMPONENT STORAGE OF A CATALYST

(71) Applicant: Robert Bosch GmbH, Stuttgart (DE)

(72) Inventor: Michael Fey, Wiernsheim (DE)

(73) Assignee: Robert Bosch GmbH, Stuttgart (DE)

( * ) Notice: Subject to any disclaimer, the term of this patent is extended or adjusted under 35 U.S.C. 154(b) by 202 days.

(21) Appl. No.: 16/725,294

(22) Filed: Dec. 23, 2019

(65) Prior Publication Data

US 2020/0208585 A1 Jul. 2, 2020

(30) Foreign Application Priority Data

Dec. 27, 2018 (DE) ..... 10 2018 251 725.8

(51) Int. Cl.

| | |
|---|---|
| ***F01N 3/00*** | (2006.01) |
| ***F02D 41/02*** | (2006.01) |
| ***F01N 9/00*** | (2006.01) |
| ***F01N 11/00*** | (2006.01) |

(52) U.S. Cl.

CPC ..... *F02D 41/0295* (2013.01); *F01N 9/005* (2013.01); *F01N 11/007* (2013.01)

(58) Field of Classification Search

CPC ..... F02D 41/0295; F02D 2200/0816; F02D 41/2451; F02D 2041/1433; F01N 9/005; F01N 11/007; F01N 2900/0402; F01N 2900/1624; F01N 9/00

USPC ..... 60/276

See application file for complete search history.

(56) References Cited

U.S. PATENT DOCUMENTS

| | | | | |
|---|---|---|---|---|
| 5,901,552 | A | 5/1999 | Schnaibel et al. | |
| 7,100,364 | B2 * | 9/2006 | Harrison | F02D 41/1475 60/285 |
| 10,927,738 | B2 * | 2/2021 | Knopp | F01N 3/101 |
| 11,111,873 | B2 * | 9/2021 | Wagner | F02D 35/0046 |
| 2020/0208559 | A1 * | 7/2020 | Fey | B01D 53/9454 |
| 2020/0347792 | A1 * | 11/2020 | Fey | F01N 3/10 |

FOREIGN PATENT DOCUMENTS

| | | |
|---|---|---|
| DE | 19606652 | 8/1997 |

* cited by examiner

*Primary Examiner* — Jason D Shanske

(74) *Attorney, Agent, or Firm* — Michael Best & Friedrich LLP

(57) ABSTRACT

A method is proposed for regulating a fill level of an exhaust component storage of a catalyst (26) of an internal combustion engine (10), wherein the regulating of the fill level is done by using a system model (100), comprising a catalyst model (102), and wherein uncertainties of measured or model variables influencing the regulating of the fill level are corrected by an adaptation, which is based on signals of an exhaust gas probe (34) arranged at the outlet side of the catalyst (26). The method is characterized in that the adaptation takes multiple pathways (200, 210, 220), wherein signals from different signal regions (260, 280, 300) of the exhaust gas probe (34) situated at the outlet side are processed on different pathways. An independent claim is addressed to a controller designed to carry out the method.

11 Claims, 4 Drawing Sheets

METHOD FOR REGULATING A FILL OF AN EXHAUST COMPONENT STORAGE OF A CATALYST

BACKGROUND OF THE INVENTION

The present invention relates to a method for regulating a fill of an exhaust component storage of a catalyst in the exhaust gas of an internal combustion engine. In its device aspects, the present invention relates to a controller.

Such a method and such a controller is known for oxygen as the exhaust gas component in each case from DE 196 06 652 B4 of the applicant.

In the known method, the regulating of the fill level is done using a system model, comprising a catalyst model. Uncertainties of measured or model variables that influence the regulating of the fill level are corrected by an adaptation based on signals of an exhaust gas probe situated at the outlet side of the catalyst. The controller is adapted to carry out such a method for this.

When incomplete combustion of the air and fuel mix in a gasoline engine occurs, in addition to nitrogen ($N_2$), carbon dioxide ($CO_2$) and water ($H_2O$) there are emitted multiple combustion products, of which hydrocarbons (HC), carbon monoxide (CO) and nitrogen oxides ($NO_x$) are limited by law. The current exhaust gas limit values for motor vehicles in the present state of the art can only be met with a catalytic exhaust gas aftertreatment. The mentioned pollution components can be converted by using a three-way catalyst.

A simultaneously high conversion rate for HC, CO and $NO_x$ is only achieved in three-way catalysts in a narrow lambda range about the stoichiometric operating point (lambda=1), the so-called conversion window.

For the operation of the three-way catalyst in the conversion window, a lambda regulation is typically employed in present-day engine control systems, based on signals from lambda probes situated upstream and downstream from the three-way catalyst. For the regulating of the air coefficient lambda, which is a measure of the composition of the fuel/air ratio of the internal combustion engine, the oxygen content of the exhaust gas is metered upstream from the three-way catalyst with an inlet-side exhaust gas probe situated there. Depending on this metered value, the regulation corrects the fuel quantity or injection pulse width, given in the form of a baseline value of a feedforward function.

In the context of the feedforward, baseline values of fuel quantities being injected are dictated in dependence on the rotary speed and load of the internal combustion engine, for example. For an even more accurate regulation, the oxygen concentration of the exhaust gas is additionally detected downstream from the three-way catalyst with a further exhaust gas probe. The signal of this outlet-side exhaust gas probe is used for a servo control which is superimposed on the lambda regulation based on the signal of the inlet-side exhaust gas probe upstream from the three-way catalyst. The exhaust gas probe situated after the three-way catalyst is generally a lambda step probe, which has a very steep characteristic when lambda=1 and can therefore indicate lambda=1 very accurately (Kraftfahrtechnisches Taschenbuch, 23rd ed., page 524).

Besides the servo control, which generally only evens out minor deviations from lambda=1 and is relatively slow in its design, present engine control systems generally have a functionality which ensures, after large deviations from lambda=1 in the form of a lambda feedforward, that the conversion window is again quickly reached, which is important for example after phases with coasting shutdown, in which the three-way catalyst is loaded with oxygen. The oxygen loading impairs the $NO_x$ conversion.

Due to the oxygen storage capacity of the three-way catalyst, lambda−1 may be present after the three-way catalyst for another several seconds after a rich or lean lambda has been set prior to the three-way catalyst. This attribute of the three-way catalyst to temporarily store oxygen is utilized to even out transient deviations from lambda=1 upstream from the three-way catalyst. If a lambda not equal to 1 exists for a lengthy time prior to the three-way catalyst, the same lambda will also be set after the three-way catalyst as soon as the oxygen fill level at lambda>1 (oxygen surplus) exceeds the oxygen storage capacity or as soon as no more oxygen is being stored in the three-way catalyst when lambda<1.

At this moment in time, a lambda step probe after the three-way catalyst also indicates a leaving of the conversion window. But up to this time, the signal of the lambda probe after the three-way catalyst will not give notice of the upcoming breakthrough, and a servo control based on this signal therefore often responds so late that the fuel metering can no longer respond in timely fashion before a breakthrough. As a result, heavier tail pipe emissions occur. Present-day regulating concepts therefore have the drawback that they only identify too late a leaving of the conversion window using the voltage of the lambda step probe after the three-way catalyst.

One alternative to the regulation based on the signal of a lambda probe after the three-way catalyst is a regulation of the medium oxygen fill level of the three-way catalyst. While this medium fill level is not measurable, it can be modeled by computations according to the above cited DE 196 06 652 B4.

However, a three-way catalyst is a complex, nonlinear system with time-variant system parameters. Furthermore, the input variables measured or modeled for a model of the three-way catalyst usually suffer from uncertainties.

SUMMARY OF THE INVENTION

The present invention in its method aspects differs from the aforementioned prior art in that the adaptation takes place on multiple pathways, wherein signals each from different signal regions of the exhaust gas probe situated at the outlet side are processed each on different pathways, and in its device aspects in that the controller is adapted to perform the adaptation on multiple pathways, wherein signals each from different signal regions of the exhaust gas probe situated at the outlet side are processed each on different pathways.

In combination with the features of the prior art method, a multistaged adaptation is realized with the characterizing features, which compensates for uncertainties of measured or modeled variables going into the system model and uncertainties of the system model.

The multistaged adaptation combines a continuously functioning, very accurate adaptation of lesser deviations and a discontinuous rapid correction of larger deviations.

The continuous adaptation and the discontinuous correction are based on signal values from different signal regions of the exhaust gas probe situated downstream from the catalyst in the exhaust gas stream and thus at the outlet side, yet two fundamentally different pieces of information are derived from these signal values. The invention makes it possible to consider the different informative force of the signal values from the different signal regions in regard to the exhaust gas composition and in regard to the fill level of the catalyst.

Furthermore, multiple signal value ranges can be provided, in which the continuous adaptation alone, the discontinuous correction alone, or both together are active.

In the discontinuous adaptation, a modeled fill level is then corrected according to the actual fill level when the voltage of an outlet-side exhaust gas probe indicates a breakthrough of rich or lean exhaust gas after the catalyst and thus too low or too high an actual oxygen fill level. This correction is made discontinuously in order to be able to assess the response of the voltage of the lambda probe after the catalyst. Since this response is delayed because of the dead time of the system and the storage behavior of the catalyst, it is provided to perform the correction at first for one time when the lambda value of the signal of the second exhaust gas probe allows a conclusion as to the actual oxygen fill level of the catalyst.

In the continuous adaptation, the lambda signal of a lambda step probe after the catalyst is compared to the modeled lambda signal after the catalyst. From this comparison, a lambda offset between the lambda before the catalyst and the lambda after the catalyst can be derived. With the lambda offset for example a lambda target value formed by a feedforward is corrected.

Basically, a model-based regulating of the fill level of a catalyst has the advantage that it can recognize earlier on an upcoming leaving of the catalyst window than in the case of a servo control, which is based on the signal of an exhaust gas probe situated downstream from the catalyst. In this way, one may counteract the leaving of the catalyst window by a timely and targeted correction of the air and fuel mix.

Thanks to the multistaged compensation of measured and modeled uncertainties according to the invention, the robustness of the model-based regulation can be improved. In this way, emissions can be further reduced. Stricter legal requirements can be fulfilled with lower costs for the catalyst. As a result, a further improved model-based regulation of the fill level of a catalyst is achieved, which recognizes and prevents a leaving of the catalyst window in timely fashion.

One preferred embodiment proposes that a correction of the feedforward of a first control loop is done by a first adaptation pathway, wherein a modeled fill level of the catalyst, which is calculated by the feedforward with a catalyst model being the inverse of the catalyst model, is adapted via the first adaptation pathway to a real fill level of the catalyst, the real fill level being ascertained from a signal of the outlet-side exhaust gas probe. This corresponds to a discontinuous correction (or a re-initialization) of the modeled fill level in the feedforward.

It is also preferred that the fill level calculated with the catalyst model is adapted by a second adaptation pathway to the real fill level, the real fill level being ascertained from a signal of the outlet-side exhaust gas probe. This corresponds to a discontinuous correction (or a re-initialization) of the modeled fill level in the system model.

Further, it is preferable for the adapting to be done discontinuously in each case.

A further preferred embodiment proposes that the adapting of the fill level calculated with the catalyst model to the real fill level is done together with an adapting of the fill level calculated with the inverse catalyst model to the real fill level by the feedforward. Since the feedforward is designed as an inverting of the system model, there would otherwise be inconsistencies between the modeled fill levels of the system model and the feedforward.

It is also preferred that the discontinuously performed adaptation processes are based on large and small signal values of the outlet-side exhaust gas probe, wherein the large signal values are separated from the small signal values by a region of medium signal values situated between the large signal values and the small signal values.

Further, it is preferred that a lambda target value formed by the feedforward is corrected with a lambda offset by a third adaptation pathway, which is derived from a comparison of an inlet-side lambda value in relation to the exhaust component storage and an outlet-side signal value of the signal of the outlet-side exhaust gas probe.

A further preferred embodiment proposes that the outlet-side signal value is a medium signal value of the signal of the outlet-side exhaust gas probe and the correction done by the third adaptation pathway is performed continuously if the signal value of the outlet-side exhaust gas probe lies in the region of medium signal values.

It is also preferred that the correction done by the third adaptation pathway is also performed for small and large signal values of the outlet-side exhaust gas probe, the correction done in the third adaptation pathway being weighted, and the influence of the correction formed in the third adaptation pathway diminishes in the region of the large signal values as the signal values become larger and diminishes in the region of the small signal values as the signal values of the outlet-side exhaust gas probe become smaller.

Further, it is preferred that the discontinuous fill level correction performed by the first adaptation pathway for small and large signal values of the outlet-side exhaust gas probe is weighted, the influence of the correction formed in the first adaptation pathway increasing in the region of the large signal values as the signal values become larger and increasing in the region of the small signal values as the signal values become smaller.

In regard to the device aspects, it is preferable for the controller to be adapted to perform a method according to one of the mentioned embodiments of the method.

Further benefits will emerge from the specification and the enclosed figures.

Of course, the above mentioned features and those yet to be explained below may be used not only in the in each case particular indicated combination, but also in other combinations or standing alone, without leaving the scope of the present invention.

BRIEF DESCRIPTION OF THE DRAWINGS

Exemplary embodiments of the invention are presented in the drawings and shall be explained more closely in the following specification. The same reference numbers in different figures each time designate here the same or at least functionally comparable elements. There are shown, each time in schematic manner.

DETAILED DESCRIPTION

The invention shall be specified in the following on the example of a three-way catalyst and for oxygen as the exhaust gas component being stored. Yet the invention is also applicable, mutatis mutandis, to other types of catalyst and exhaust gas components such as nitrogen oxides and hydrocarbons. In the following, for sake of simplicity, we shall assume an exhaust gas system with a three-way catalyst. The invention is also applicable, mutatis mutandis, to exhaust gas systems with multiple catalysts. The following described front and rear zones may also extend in this case over multiple catalysts or be situated in different catalysts.

Figure 1:
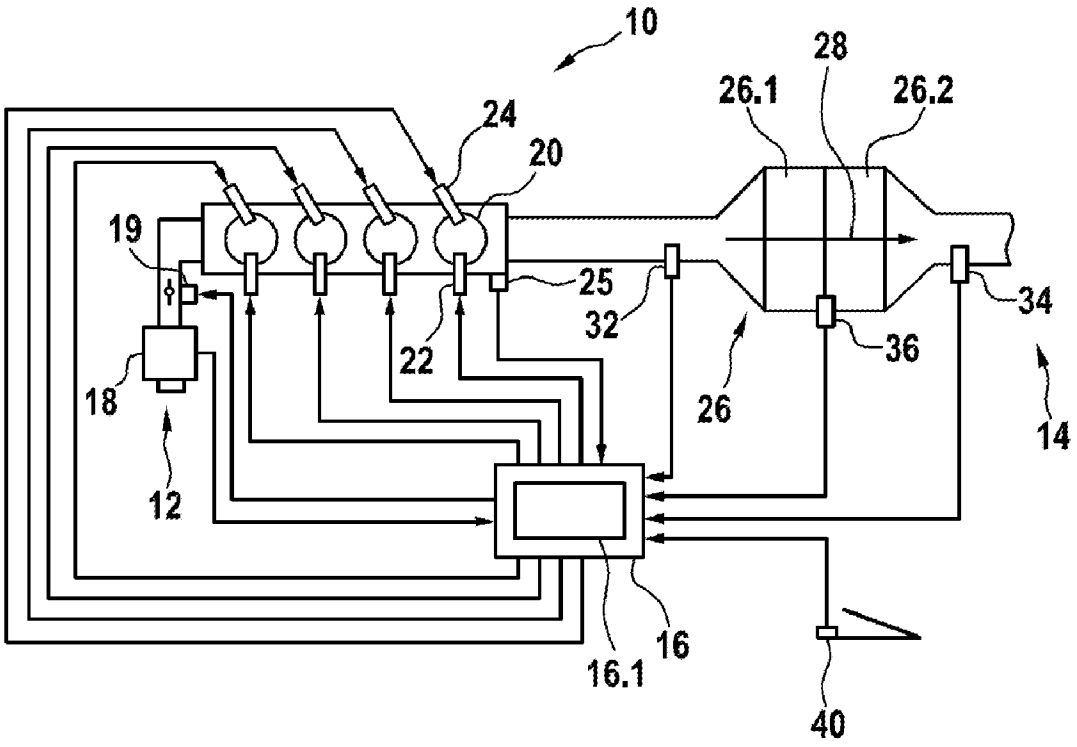
FIG. 1 an internal combustion engine with an air supply system, an exhaust gas system and a controller.

Specifically, FIG. 1 shows an internal combustion engine 10 with an air supply system 12, an exhaust gas system 14 and a controller 16. In the air supply system 12, there is located an air mass meter 18 and, situated downstream from the air mass meter 18, a throttle valve of a throttle valve unit 19. The air flowing via the air supply system 12 into the internal combustion engine 10 is mixed with fuel in combustion chambers 20 of the internal combustion engine 10, having been injected directly by injection valves 22 into the combustion chambers 20. The invention is not limited to internal combustion engines with direct injection and may also be used with intake pipe injection or with gas-operated internal combustion engines. The resulting combustion chamber fills are ignited with ignition devices 24, such as spark plugs, and burned. A rotation angle sensor 25 detects the rotation angle of a shaft of the internal combustion engine 10 and in this way allows the controller 16 to trigger the ignitions in predetermined angle positions of the shaft. The exhaust gas resulting from the combustions is taken away through the exhaust gas system 14.

The exhaust gas system 14 comprises a catalyst 26. The catalyst 26 is for example a three-way catalyst, which as is known converts the three exhaust gas components of nitrogen oxides, hydrocarbons, and carbon monoxide along three reaction pathways and has an oxygen-storing action. Due to the oxygen-storing action, and because oxygen is an exhaust gas component, the catalyst has an exhaust component storage. The three-way catalyst 26 in the example shown comprises a first zone 26.1 and a second zone 26.2. Exhaust gas 28 flows through both zones. The first, forward zone 26.1 extends in the flow direction along a forward region of the three-way catalyst 26. The second, rear zone 26.2 extends downstream from the first zone 26.1 along a rear region of the three-way catalyst 26. Of course, further zones may be situated in front of the forward zone 26.1 and after the rear zone 26.2 as well as between the two zones, for which the respective fill level may also possibly be modeled with a computer model.

Upstream from the three-way catalyst 26 there is arranged an inlet-side exhaust gas probe 32, exposed to the exhaust gas 28, immediately in front of the three-way catalyst 26. Downstream from the three-way catalyst 26, and likewise exposed to the exhaust gas 28, an outlet-side exhaust gas probe 34 is arranged immediately after the three-way catalyst 26. The inlet-side exhaust gas probe 32 is preferably a broadband lambda probe, enabling a metering of the air coefficient $\lambda$ away over a broad range of air coefficients. The outlet-side exhaust gas probe 34 is preferably a so-called lambda step probe, with which the air coefficient $\lambda=1$ can be measured especially accurately, because the signal of this exhaust gas probe 34 changes abruptly there. See Bosch, Kraftfahrtechnisches Taschenbuch, 23rd ed., page 524.

In the exemplary embodiment shown, a temperature sensor 36 exposed to the exhaust gas 28 is situated in thermal contact with the exhaust gas 28 at the three-way catalyst 26, detecting the temperature of the three-way catalyst 26.

The controller 16 processes the signals of the air mass meter 18, the rotation angle sensor 25, the inlet-side exhaust gas probe 32, the outlet-side exhaust gas probe 34 and the temperature sensor 36 and forms from these actuating signals to set the angle position of the throttle valve, to trigger ignitions by the ignition device 24 and to inject fuel through the injection valves 22. Alternatively or additionally, the controller 16 also processes signals from other or further sensors to actuate the represented control elements or also further or other control elements, such as the signal of a driver's intention generator 40, which detects a gas pedal position. A coasting operation with disconnection of the fuel feed is triggered for example by easing up on the gas pedal. These functions and those yet to be explained in the following are executed by an engine control program 16.1 running in the controller 16 during the operation of the internal combustion engine 10.

In this application, we shall refer to a system model 100, a catalyst model 102, an output lambda model 106 (see FIG. 2) and an inverse catalyst model. The models in each case are algorithms, especially systems of equations which are executed or calculated in the controller 16, and which relate the input variables, also acting on the real object simulated with the computer model, to connect output variables in such a way that the output variables calculated with the algorithms correspond as accurately as possible to the output variables of the real object.

Figure 2:
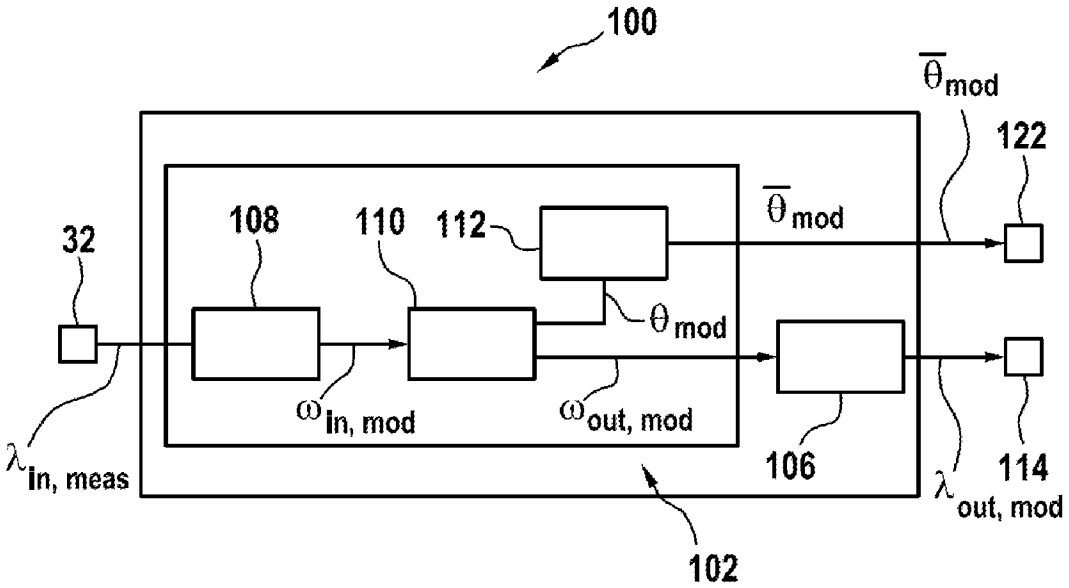
FIG. 2 a functional block representation of a system model.

FIG. 2 shows a functional block representation of a system model 100. The system model 100 consists of the catalyst model 102 and the output lambda model 106. The catalyst model 102 comprises an input emission model 108 and a fill level and output emission model 110. Furthermore, the catalyst model 102 has an algorithm 112 for calculating a mean fill level $\bar{\theta}_{mod}$ of the catalyst 26.

The input emission model 108 is adapted to convert the signal $\lambda_{in,meas}$ of the exhaust gas probe 32 located in front of the three-way catalyst 26, as the input variable, into the input variables $w_{in,mod}$ required for the following fill level and output emission model 110. For example, a conversion of lambda into the concentrations of O2, CO, H2 and HC in front of the three-way catalyst 26 with the aid of the input emission model 108 is advantageous.

With the variables $w_{in,mod}$ calculated by the input emission model 108 and optionally additional input variables (such as exhaust gas or catalyst temperatures, exhaust gas mass flow and current maximum oxygen storage capacity of the three-way catalyst 26), a fill level $\theta_{mod}$ of the three-way catalyst 26 and concentrations $w_{out,mod}$ of the individual exhaust gas components at the output of the three-way catalyst 26 are modeled in the fill level and output emission model 110.

In order to realistically portray the filling and emptying processes, the three-way catalyst 26 is preferably divided by the algorithm theoretically into several zones or partial volumes 26.1, 26.2 located in succession in the flow direction of the exhaust gas 28, and the concentrations of the individual exhaust gas components are ascertained for each of these zones 26.1, 26.2 with the aid of the reaction kinetics. These concentrations may in turn be converted each time into a fill level of the individual zones 26.1, 26.2, preferably into the oxygen fill level normalized to the current maximum oxygen storage capacity.

The fill levels of individual or all zones 26.1, 26.2 may be combined by a suitable weighting into a total fill level, representing the state of the three-way catalyst 26. For example, the fill levels of all zones 26.1, 26.2 in the most simple case are all equally weighted and a mean fill level is ascertained in this way. But with a suitable weighting it is also possible to allow for the fact that the fill level in a relatively small zone 26.2 at the outlet of the three-way catalyst 26 is decisive for the momentary exhaust gas composition after the three-way catalyst 26, while the fill level and its development in the zone 26.1 situated in front of this small zone 26.2 is decisive for the development of the fill level in that small zone at the outlet of the three-way catalyst 26. For simplicity, we shall assume a mean oxygen fill level in the following.

The algorithm of the output lambda model 106 converts the concentrations $w_{out,mod}$ of the individual exhaust gas components at the outlet of the catalyst 26, as calculated with the catalyst model 102, into a signal $\lambda_{out,mod}$ which can be compared to the signal $\lambda_{out,meas}$ of the exhaust gas probe 34 situated after the catalyst 26 for the adaptation of the system model 100. Preferably, the lambda after the three-way catalyst 26 is modeled. The output lambda model 106 is not necessarily required for a feedforward based on a target oxygen fill level.

The system model 100 thus serves on the one hand for the modeling of at least one mean fill level $\overline{\theta}_{mod}$ of the catalyst 26, which is regulated toward a target fill level at which the catalyst 26 will be located with certainty inside the catalyst window (and thus can both take up and give off oxygen). On the other hand, the system model 100 provides a modeled signal $\lambda_{out,mod}$ of the exhaust gas probe 34 situated after the catalyst 26. It shall be further explained below how this modeled signal $\lambda_{out,mod}$ of the outlet-side exhaust gas probe 34 is used advantageously for the adaptation of the system model 100. The adaptation is done to compensate for uncertainties affecting the input variables of the system model, especially the signal of the lambda probe in front of the catalyst. The feedforward is likewise adapted.

Figure 3:
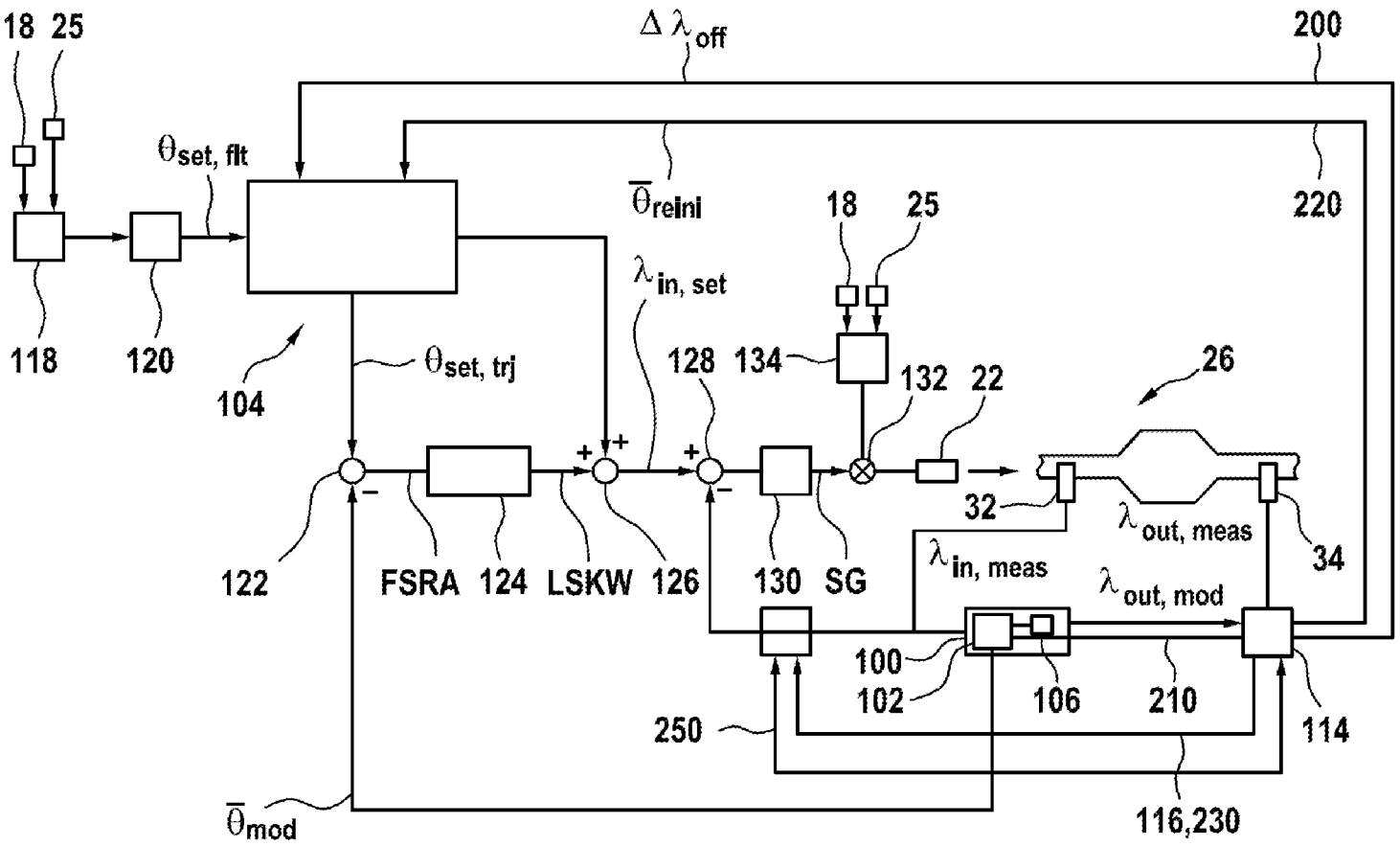
FIG. 3 a functional block representation illustrating both method aspects and device aspects of the invention.

FIG. 3 shows a functional block representation illustrating both method aspects and device aspects of the invention. Specifically, FIG. 3 shows that the signal $\lambda_{out,mod}$ of the outlet-side exhaust gas probe 34 modeled by the output lambda model 106 and the real output signal $\lambda_{out,meas}$ of the outlet-side exhaust gas probe 34 are taken to an adaptation block 114. The adaptation block 114 compares the two signals $\lambda_{out,mod}$ and $\lambda_{out,meas}$ with each other. For example, a lambda step probe situated after the three-way catalyst 26, being the exhaust gas probe 34, clearly indicates when the three-way catalyst 26 is completely filled with oxygen or completely depleted of oxygen.

This can be utilized in order to bring the modeled oxygen fill level after lean or rich. phases into conformity with the actual oxygen fill level, or the modeled output lambda $\lambda_{out,meas}$ into conformity with the lambda $\lambda_{out,meas}$ measured after the three-way catalyst 26, and to adapt the system model 100 in event of deviations.

A first adaptation pathway 220 emerging from the adaptation block 114 goes to the feedforward 104. By this adaptation pathway 220, the modeled fill level used in the inverse catalyst model of the feedforward 104 is adapted to the real fill level. This corresponds to a discontinuous correction (or a re-initialization) of the modeled fill level in the feedforward 104.

A second adaptation pathway 210 emerging from the adaptation block 114 goes to the system model 100. By the second adaptation pathway 210, the modeled fill level used in the system model 100 is adapted to the real fill level. This corresponds to a discontinuous correction (or a re-initialization) of the modeled fill level in the system model 100.

The two interventions of the discontinuous correction preferably always occur together, i.e., at the same time, since the feedforward is designed as an inverting of the system model. Otherwise, there would be inconsistencies of the modeled fill levels in the two functional blocks of the system model 100 and the feedforward 104.

These interventions form a first adaptation stage. These discontinuously occurring adaptation processes are based on large and small (but not mean) signal values of the outlet-side exhaust gas probe 34.

A third adaptation pathway 200 emerging from the adaptation block 114 goes to the feedforward 104. By the third adaptation pathway 200, a continuous adaptation is done, based on mean signal values of the outlet-side exhaust gas probe 34. At these mean signal values, the signal of the outlet-side exhaust gas probe 34 accurately indicates the lambda value of the exhaust gas. If an offset $\Delta\lambda_{offs}$ occurs in the lambda control loop, which may be the case due to an error of the inlet-side exhaust gas probe 32 or a leakage air supply to the exhaust gas between the two exhaust gas probes, the signal of the outlet-side exhaust gas probe 34 lying in the zone of mean signal values will indicate this offset $\Delta\lambda_{offs}$ as a deviation from an expected value. The deviation is determined in block 114 for example as the difference between signal value and expectation value and is added into the lambda target value in the feedforward 104. This may be done, for example, by adding the lambda offset value $\Delta\lambda_{offs}$ to a preliminary feedforward lambda value.

There is a need for adaptation if the two values (signal value and expectation value) differ, especially by more than a given threshold value. It is advantageous to correct the target lambda value for the inlet-side lambda value and the ascertained target fill level trajectory with a lambda offset value, representing a measure of the need for adaptation. This measure of the need for adaptation results from the difference between the outlet-side lambda value as modeled with the aid of the system model and the measured outlet-side lambda value, especially as their difference as the lambda offset value.

Thanks to the correction of the target lambda value for the inlet-side lambda value, the lambda regulation can respond immediately to changes in the lambda offset value. Since the system model is adapted, even if the modeled mean fill level deviates from the actual fill level, because the target value trajectory of the target fill level is likewise adapted it will follow the wrong modeled fill level of the system model, so that the fill level regulator before and after the adaptation will see this same control deviation. This prevents jumps in the control deviation, which might result in rises in the fill level regulation.

It is advantageous to smooth out the measure of the need for adaptation, i.e., a difference between the modeled outlet-side lambda value and the measured outlet-side lambda value, with the aid of a filter in an adaptation block, in order to obtain the lambda offset value. The filter may be designed for example as a PT1 filter and may have a time constant dependent on the operating point, which can be taken for example from a corresponding parametrizable characteristic diagram. Optionally, an integrator may be connected in series with the filter in order to take account of long-term effects. In the steady state, the filtered signal corresponds exactly to the need for adaptation.

Furthermore, it is advisable to save the adaptation value at the end of a driving cycle and to use the corresponding adaptation value as the starting value for a next driving cycle.

In one embodiment, a fourth adaptation pathway 230 is present as an option. The fourth adaptation pathway leads from the adaptation block 114 to a block 240 in which an actual lambda value of the inlet-side exhaust gas probe 32 is related additively to the lambda offset value.

The adaptation done continuously at the lambda level should advisedly result sooner or later in a correction at the location where the lambda offset has its origin. Generally, this will be the case at the inlet-side exhaust gas probe 32. Therefore, it is advantageous to correct the measurement signal $\lambda_{in,meas}$ of the inlet-side exhaust gas probe 32 with the signal $\Delta\lambda_{offs}$. In FIG. 3, this is done in block 240. A handshake between the blocks 240 and the adaptation block 114 is advantageous so that this does not cause a double correction in the feedforward and the block 240. The handshake occurs, for example, via a handshake path 250, so that the correction signal for the feedforward block 104 is reduced by the amount which is related in the block 240 to the actual value of the signal of the inlet-side exhaust gas probe 32. For this, one of the two corrections can be multiplied for example by a factor x with 0<x<1 when the other of the two corrections is multiplied with the factor (1−x).

On the whole, the various adaptation processes compensate for uncertainties of measurement or model variables going into the system model 100. Because the modeled value $\lambda_{out,mod}$ corresponds to the measured lambda value $\lambda_{out,meas}$, it may be inferred that the fill level $\overline{\theta}_{mod}$ modeled with the system model 100, or with the first catalyst model 102, corresponds to the fill level of the three-way catalyst 26 which is not measurable with on board means. Furthermore, it may then be concluded that the second catalyst model, which is the inverse of the first catalyst model 102 and forms part of the feedforward 104, correctly describes the behavior of the modeled system.

This may be utilized to calculate a baseline lambda target value with the inverse second catalyst model, which is part of the feedforward 104. For this, the feedforward 104 is furnished with a fill level target value $\overline{\theta}_{set,flt}$, filtered by an optional filtering 120, as an input variable. The filtering 120 is done for the purpose of allowing only such changes in the input variable of the feedforward 104 as can be followed by the controlled system as a whole. An as yet unfiltered target value $\overline{\theta}_{set}$ is fetched from a memory 118 of the controller 16. For this, the memory 118 is preferably addressed with current operating parameters of the internal combustion engine 10. The operating parameters are, for example but not necessarily, the rotary speed as detected by the RPM sensor 25 and the load of the internal combustion engine 10 as detected by the air mass meter 18.

In the feedforward block 104, on the one hand a feedforward lambda value is determined as the baseline lambda target value BLSW and on the other hand a target fill level trajectory $\overline{\theta}_{set,trj}$ is determined in dependence on the filtered fill level target value. In parallel with this determination, a fill level control deviation FSRA is formed in a logic operation 122 as a deviation of the fill level $\overline{\theta}_{mod}$ modeled with the system model 100, or that modeled with the first catalyst model 102, from the filtered till level target value $\overline{\theta}_{set,flt}$, or from the target fill level trajectory $\overline{\theta}_{set,trj}$. This fill level control deviation FSRA is furnished to a fill level control algorithm 124, which forms from it a lambda target value correction value LSKW. This lambda target value correction value is added in the logic operation 126 to the baseline lambda target value BLSW calculated by the feedforward 104.

The sum so formed may serve as a target value $\lambda_{in,set}$ of a conventional lambda regulation. From this lambda target value $\lambda_{in,set}$ there is subtracted the lambda actual value $\lambda_{in,meas}$ provided by the first exhaust gas probe 32 in a logic operation 128. The control deviation RA so formed is converted by a customary control algorithm 130 into a manipulated variable SG, which is related in a for example multiplicative, logic operation 132, to a baseline value BW of an injection pulse width $t_{inj}$ that is predetermined in dependence on operating parameters of the internal combustion engine 10. The baseline values BW are saved in a memory 134 of the controller 16. The operating parameters here as well as preferably, but not necessarily, the load and the rotary speed of the internal combustion engine 10. The injection valves 22 are actuated with the injection pulse width $t_{inj}$ resulting from the product.

In this manner, the conventional lambda regulation occurring in a first control loop is superimposed with a regulating of the oxygen fill level of the catalyst 26, which occurs in a second control loop. The mean oxygen fill level $\overline{\theta}_{mod}$ modeled with the aid of the system model 100 is regulated for example to a target value $\overline{\theta}_{set,flt}$, which minimizes the probability of breakthroughs after lean and rich operation and thus results in minimum emissions. Due to the formation of the baseline lambda target value BLEW by the inverted second system model of the feedforward 104, the control deviation of the fill level regulation becomes equal to zero when the modeled mean fill level $\overline{\theta}_{mod}$ is identical to the prefiltered target fill level $\overline{\theta}_{set,flt}$. The realization of the feedforward 104 as an inverting of the system model 100 has the benefit that the fill level control algorithm 124 only needs to intervene when the actual fill level of the catalyst as modeled with the aid of the system model deviates from the filtered fill level target value $\overline{\theta}_{set,flt}$ or the unfiltered fill level target value $\overline{\theta}_{set}$.

While the system model 100 converts the input lambda in front of the catalyst into a mean oxygen fill level of the catalyst, the feedforward 104 realized as an inverted system model converts the mean target oxygen fill level into a corresponding target lambda in front of the catalyst.

The feedforward 104 comprises a numerically inverted computer model, based on a first system model 100 for the catalyst 26 which is assumed to be known. In particular, the feedforward 104 comprises a second system model whose system of equations is identical to the system of equations of the first system model 100, but is furnished with different input variables.

The feedforward 104 provides a feedforward lambda value BSLW for a lambda regulation and a target fill level trajectory $\overline{\theta}_{set,trj}$ in dependence on the filtered fill level target value. In order to calculate the feedforward lambda value BSLW, corresponding to the filtered fill level target value, the feedforward block 104 contains a computer model, corresponding to a system model being the inverse of the system model 100, i.e., a model assigning a baseline lambda target value BLSW as a preliminary feedforward lambda value to a filtered fill level target value. The desired fill level then results for a properly chosen BLSW.

The advantage of this procedure is that it is only necessary to solve the system of equations for the forward system model 100, or 100', one further time, but not the system of equations for the backward system model of the feedforward 104 from FIG. 3, which can only be done with large computation expense or not at all.

The system of equations to be solved is solved by iteration using inclusion methods, such as for example the bisection or Regula Falsi methods. In this process, the baseline lambda target value is changed iteratively. Inclusion methods such as the Regula Falsi are generally known. They are characterized in that they not only provide iterative approximation values, but also bound them on either side. The computation expense for determining the proper baseline lambda target value BLSW is thus significantly limited.

In order to minimize the computation expense in the controller 16, iteration limits are preferably established, determining the zone in which the iteration will be performed. Preferably, these iteration limits are set in dependence on the current operating conditions. For example, it is advantageous to perform the iteration only in a smallest possible interval about the expected target lambda BLSW. Furthermore, it is advantageous to take into account the intervention of the fill level regulation 124 and interventions of other functionalities on the target lambda BLSW when determining the iteration limits.

Figure 4:
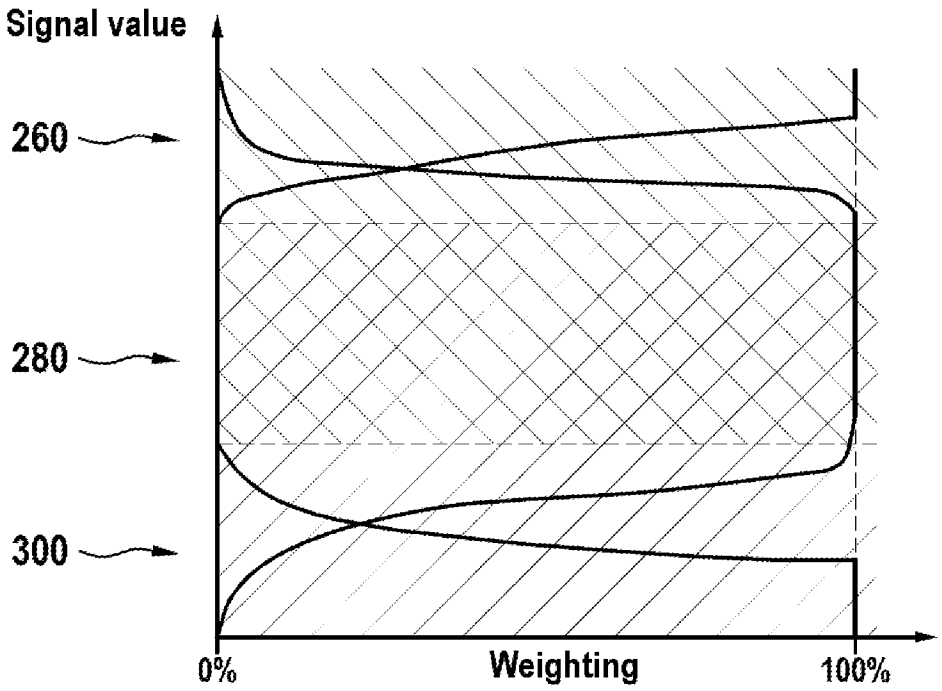
FIG. 4 voltage regions of an outlet-side exhaust gas probe plotted against a weighting scale.

With the exception of the exhaust gas system 26, the exhaust gas probes 32, 34, the air mass meter 18, the rotation angle sensor 25 and the injection valves 22, all the elements represented in FIG. 4 are parts of a controller 16 according to the invention. With the exception of the memories 118, 134, all other elements here from FIG. 4 are parts of the engine control program 16.1, which is stored in the controller 16 and can be fetched from it.

The elements 22, 32, 128, 130 and 132 form the first control loop, in which a lambda regulation occurs, in which the signal $\lambda_{in,meas}$ of the first exhaust gas probe (32) is processed as the lambda actual value. The lambda target value $\lambda_{in,set}$ of the first control loop is formed in the second control loop, comprising the elements 22, 32, 100, 122, 124, 126, 128, 132.

In regard to the various adaptation possibilities, it is preferable to combine a continuous adaptation with at least one discontinuous correction. This utilizes the fact that it is possible to derive, from the voltage signal of a lambda step probe after the catalyst, two fundamentally different conclusions as to the state of the catalyst, that the validity of these conclusions is only given in certain voltage ranges of the voltage signal in each case, and that there are voltage ranges in which only one or only the other conclusion, or both conclusions at the same time, are possible. The transitions between the ranges are fluid.

When the outlet-side exhaust gas probe 34 after the catalyst 26 clearly indicates a high or a low voltage, its signal value is correlated with the current fill level of the catalyst. This is the case, in particular, when the signal value does not correspond to a lambda in the zone of 1. In this case, the catalyst is so much depleted of oxygen, or so much filled with oxygen, that rich or lean exhaust gas respectively breaks through. As a rule, no statement about the exhaust gas lambda is possible in these instances, because the lambda accuracy of the signal value here is heavily affected by temperature effects, cross sensitivities, and the flat curve of the voltage/lambda characteristic of the lambda step probe as the exhaust gas probe 34.

In a narrow range about lambda=1, the signal value of the outlet-side exhaust gas probe 34 (lambda step probe) is correlated with the exhaust gas lambda after the catalyst. The lambda precision in this zone is very high on account of the steep curve of the voltage/lambda characteristic and the little temperature dependence or cross sensitivity. A statement as to the current fill level of the catalyst 26 is generally not possible in this case, because the catalyst 26 can set an exhaust gas lambda of 1 in a relatively large fill level range as long as the oxygen liberated during the reduction of exhaust gas components can still be stored or the oxygen needed for the oxidation of exhaust gas components can still be furnished.

In the transitions between these zones, the signal value of the outlet-side exhaust gas probe 34 correlates at the same time with both the current fill level and the current exhaust gas lambda after the catalyst, albeit with limited accuracy in each case.

In one embodiment therefore multiple zones exist, depending on the voltage/signal value of the outlet-side exhaust gas probe 34, in which either only a continuous adaptation making use of the lambda information or only a discontinuous correction making use of the fill level information or both a continuous adaptation and a discontinuous correction making use of both pieces of information is expedient.

For example, it is appropriate to distinguish the following five voltage ranges of the voltage signal values of the outlet-side exhaust gas probe 34:

1) Very high voltage signal values (e.g., greater than 900 mV). Here, there occurs a discontinuous correction of the modeled oxygen fill level to a very low value. No continuous adaptation is done.
2) High voltage signal values (e.g., between 900 mV and 800 mV). Here, there occurs a discontinuous correction of the modeled oxygen fill level to a low value, and superimposed on this is a continuous adaptation of a Lambda offset between the lambda before the catalyst and the lambda after the catalyst.
3) Medium voltage signal values (e.g., between 800 mV and 600 mV). Here, there occurs a continuous adaptation of a Lambda offset between the lambda before the catalyst and the lambda after the catalyst. No discontinuous adaptation is done.
4) Low voltage signal values (e.g., between 600 mV and 400 mV). Here, there occurs a discontinuous correction of the modeled oxygen fill level to a high value, and superimposed on this is a continuous adaptation of a Lambda offset between the lambda before the catalyst and the lambda after the catalyst.
5) Very low voltage signal values (e.g., less than 400 mV). Here, there occurs a discontinuous correction of the modeled oxygen fill level to a very high value. No continuous adaptation is done.

The numerical values are heavily dependent on the type of exhaust gas probe used and should only be considered as examples. Of course, further ranges may be added, and ranges may be combined or omitted.

A discontinuous correction of the modeled fill level as in ranges 1), 2), 4) and 5) results in a deviation of the modeled fill level from the target value. This is subsequently regulated out. The deviation results in a shifting of the air and fuel mix in the direction of the target value of the fill level regulation and brings the catalyst very quickly in the direction of the catalyst window. Thus, it results immediately in an emission improvement and is capable of quickly compensating for large measurement and model uncertainties.

After such a correction phase, i.e., once the control deviation has been regulated out thanks to the correction, the catalyst should be once again in the catalyst window and should remain there thanks to the regulation. This presumes that the uncertainties of measurement or model variables going into the system model, and the model uncertainties, are small enough. If this assumption is not correct, the catalyst window will again be left after a certain time, despite the regulation, because the modeled fill level set by the regulation does not correspond to the actual fill level, so that a new correction of the modeled fill level becomes necessary.

When such a correction is necessary to repeat in the ranges 1) and 5), one must assume a rather large measurement or model uncertainty. In order to compensate for this and at the same time avoid further repetitions of the correction, it is advantageous to calculate in ranges 1) and 5) a lambda offset $\lambda_{Offs}$ between the lambda in front of the catalyst and the lambda after the catalyst from the oxygen quantity put into or removed from the catalyst after a first correction phase and until a second correction phase and the need for a correction $\Delta\theta \cdot OSC$ for the fill level ascertained in the second correction phase, for example using the following formula, and for example to correct the signal value of the inlet-side exhaust gas probe 32 accordingly $$\lambda_{Offs} = \frac{1}{1 - \frac{\Delta\theta \cdot OSC}{K \cdot \int \dot{m}_{Luft}}} - 1$$

Here, $K \cdot \int \dot{m}_Luft$ is the oxygen quantity put into or removed from the catalyst 26 between two discontinuous corrections and $\Delta\theta \cdot OSC$ is the need for a correction as ascertained in the second correction phase for the fill level. $\Delta\theta$ is a number between −1 and 1 and OSC is the maximum oxygen storage capacity of the catalyst.

In the ranges 2) and 4), typically only a slight measurement or model uncertainty exists, which can ideally be compensated already by a onetime correction of the modeled oxygen fill level and the superimposed continuous adaptation of the lambda offset $\lambda_{Offs}$ to such an extent that the voltage of the lambda probe thereafter lies in the range 3).

Once this is the case, it may be presumed that only a slight measurement or model uncertainty still needs to be compensated for. This is accomplished by the continuous adaptation with high accuracy. On account of the lower lambda precision of the signal of the outlet-side exhaust gas probe 34 in ranges 2) and 4), it is advantageous to give less weight to the lambda offset $\lambda_{Offs}$ determined in these ranges by means of the continuous adaptation than in range 3). Likewise, it is advantageous to allow for the lower accuracy of the fill level information of the signal of the lambda probe after the catalyst in ranges 2) and 4) by moderating the ascertained need for correction in order to reliably avoid an over-correction.

In an especially preferred embodiment, only three regions of the voltage of the lambda probe after the catalyst are distinguished:

FIG. 4 shows for example three voltage regions of an outlet-side exhaust gas probe 34 for n voltage regions of the outlet-side exhaust gas probe 34 plotted against a weighting scale.

A first region 260 of large signal values is characterized by high probe voltages/signal values, being larger than 800 mV, for example. In this region, a rapid, discontinuous correction of the modeled oxygen fill level to a low value, being dependent on the probe voltage, is done in a first stage. Furthermore, a precise, slower determination of a lambda offset between the lambda in front of the catalyst and the lambda after the catalyst is done, the weight of the continuous adaptation diminishing with increasing probe voltage and the weight of the discontinuous adaptation increasing with increasing probe voltage/signal value.

A second region 280 of medium signal values is characterized by medium probe voltages/signal values, lying for example (around lambda=1) between 800 mV and 600 mV. In this region, only a continuous adaptation of a lambda offset between the lambda in front of the catalyst and the lambda after the catalyst is done. No discontinuous adaptation is done.

A third region 300 of small signal values is characterized by low probe voltages/signal values, which are smaller than 600 mV, for example. In this region, a rapid, discontinuous correction is done for the modeled oxygen fill level to a high value, being dependent on the probe voltage. Furthermore, a precise, slower determination of a lambda offset between the lambda in front of the catalyst and the lambda after the catalyst is done, the weight of the continuous adaptation diminishing with decreasing probe voltage and the weight of the discontinuous adaptation increasing with decreasing probe voltage.

The decreased lambda accuracy of the signal value of the outlet-side exhaust gas probe 34 in the first region 260 and in the third region 300 as well as the decreased accuracy of the fill level information of the signal value of a lambda step probe as the outlet-side exhaust gas probe 34 for medium probe voltage is taken into account by the different weighting of the results of the continuous lambda offset adaptation and the discontinuous lambda offset determination.

It is preferable for the individual corrections and adaptations to occur only when suitable operating conditions are present, in order to avoid a faulty correction or adaptation. For example, it will be understood that all mentioned corrections and adaptations can only then be successfully carried out when the signal of the outlet-side exhaust gas probe 34 is reliable, i.e., in particular only when this exhaust gas probe 34 is ready to operate. Preferably, independent conditions will be chosen for the individual corrections and adaptations, making it possible for each correction or adaptation to be active as often as possible without this resulting in a faulty correction or adaptation.

Thanks to the combination according to the invention of the two methods for determination of the lambda offset, the use of two different pieces of information about the state of the catalyst, and the allowance for the reliability of this information in different zones of the underlying measurement signal, measurement and model inaccuracies can be compensated for more quickly and at the same time in a more robust manner than heretofore with the required accuracy.

The invention claimed is:

1. A method for regulating a fill level of an exhaust component storage of a catalyst (26) of an internal combustion engine (10), the method comprising:

regulating the fill level using a system model (100) that includes a catalyst model (102), and correcting uncertainties of measured or model variables influencing the regulating of the fill level by an adaptation based on signals of an exhaust gas probe (34) arranged at an outlet side of the catalyst (26), wherein the adaptation takes place on multiple pathways (210, 220, 230), and wherein signals from different signal regions (260, 280, 300) of the exhaust gas probe (34) are processed each on different pathways.

2. The method according to claim 1, wherein a correction of a feedforward (104) of a first control loop (22, 32, 128, 130, 132) is performed by a first adaptation pathway (220) of the multiple pathways, wherein a modeled fill level of the catalyst (26), which is calculated with an inverse catalyst model of the feedforward (104), is adapted via the first adaptation pathway (220) to a real fill level of the catalyst (26), the real fill level being ascertained from at least one of the signals of the exhaust gas probe (34).

3. The method according to claim 2, wherein the fill level calculated with the catalyst model (102) is adapted by a second adaptation pathway (210) of the multiple pathways to the real fill level, the real fill level being ascertained from at least one of the signals of the exhaust gas probe (34).

4. The method according to claim 2, wherein the adapting is performed discontinuously.

5. The method according to claim 4, wherein adapting of the fill level calculated with the catalyst model (102) is performed together with an adapting of the fill level calculated with the inverse catalyst model to the real fill level by the feedforward (104).

6. The method according to claim 5, wherein the discontinuously performed adaptation processes are based on large and small signal values of the exhaust gas probe (34), wherein a region (260) of large signal values is separated from a region (300) of small signal values by a region (280) of medium signal values situated between the large signal values and the small signal values.

7. The method according to claim 2, wherein a lambda target value (BLSW) formed by the feedforward (104) is corrected with a lambda offset by a third adaptation pathway (200) of the multiple pathways, which is derived from a comparison of an inlet-side lambda value in relation to the exhaust component storage and an outlet-side signal value of the exhaust gas probe (34).

8. The method according to claim 7, wherein the outlet-side signal value is a medium signal value of the signal of the exhaust gas probe (34) and the correction performed by the third adaptation pathway (200) is performed continuously if the signal value of the exhaust gas probe lies in the region of medium signal values.

9. The method according to claim 8, wherein the correction performed by the third adaptation pathway (200) is also performed for small and large signal values of the exhaust gas probe (34), the correction performed by the third adaptation pathway (200) being weighted, and the influence of the correction formed in the third adaptation pathway (200) diminishes in the region of the large signal values as the signal values become larger and diminishes in the region of the small signal values as the signal values of the exhaust gas probe (34) become smaller.

10. The method according to claim 9, wherein the discontinuous fill level correction performed by the first adaptation pathway (220) for small and large signal values of the exhaust gas probe (34) is weighted, the influence of the correction formed in the first adaptation pathway (220) increasing in the region of the large signal values as the signal values become larger and increasing in the region of the small signal values as the signal values become smaller.

11. A system configured to regulate a fill level of an exhaust component storage of a catalyst (26) of an internal combustion engine (10), the system comprising:

an exhaust gas probe; and a controller electrically connected to the exhaust gas probe and configured to regulate the fill level using a system model (100) that includes a catalyst model (102) and in which uncertainties of measured or model variables influencing the regulating of the fill level are corrected by an adaptation which is based on signals from the exhaust gas probe (34), wherein the controller (16) is configured to perform the adaptation on multiple pathways (200, 210, 220), wherein signals each from different signal regions (260, 280, 300) of the exhaust gas probe (34) are processed each on different pathways.

* * * * *